US005669172A

United States Patent [19]

Goral

[11] Patent Number: 5,669,172

[45] Date of Patent: Sep. 23, 1997

[54] GUN SAFETY DEVICE

[76] Inventor: Norbert Goral, 15 Ravenview Drive, Whitby, Ontario, Canada, L1R 1Y2

[21] Appl. No.: 530,819

[22] Filed: Sep. 20, 1995

[51] Int. Cl.[6] ..... F41A 35/04

[52] U.S. Cl. ..... 42/96; 42/70.01; 42/66; 42/96

[58] Field of Search ..... 42/70.11, 70.01, 42/66, 96; 89/30

[56] References Cited

U.S. PATENT DOCUMENTS

| | | | |
|---|---|---|---|
| 4,090,005 | 5/1978 | Morgan | 428/76 |
| 4,151,996 | 5/1979 | Lee et al. | 273/102.4 |
| 4,213,375 | 7/1980 | Pedler | 89/31 |
| 4,728,109 | 3/1988 | Simonetti | 273/410 |
| 4,777,753 | 10/1988 | Stancato | 42/70.11 |
| 4,877,131 | 10/1989 | Patros et al. | 206/317 |
| 5,046,276 | 9/1991 | Morris | 42/70.01 |
| 5,200,256 | 4/1993 | Dunbar | 428/212 |
| 5,512,348 | 4/1996 | Mazelsky | 428/102 |

*Primary Examiner*—Charles T. Jordan
*Assistant Examiner*—Meena Chelliah
*Attorney, Agent, or Firm*—Bereskin & Parr

[57] ABSTRACT

A gun safety device is mounted on a gun barrel for capturing a projectile fired from the gun. The device is comprised of industrial strength fabric and has an impact absorption zone for absorbing the momentum of the projectile. A method for capturing a projectile with a projectile capturing means made from fabric and releasing firing gases through pressure release holes is also provided.

17 Claims, 1 Drawing Sheet

GUN SAFETY DEVICE

FIELD OF THE INVENTION

This invention relates to a safety device mounted on the barrel of a gun for capturing projectiles discharged from the gun.

BACKGROUND OF THE INVENTION

Firearms are widely used for recreational purposes, such as hunting, and as a means for personal defense. A wide variety of guns are available on the market today. The increase in the use of firearms by the public has led to an increased concern for safety mechanisms and procedures. Since accidental discharges of guns can cause damage and severe and fatal injuries, protection against accidental discharges is a primary and serious concern.

It is often necessary for a firearm to be carried or stored while it is loaded with a bullet in the chamber, ready to be fired. For example, a hunter will carry a loaded rifle, so that in a chance encounter with prey, a shot can be quickly taken. Similarly, a personal firearm which is used to defend against intruders is often stored loaded, so that if it is necessary to use the gun in an emergency, time will not be wasted searching for bullets and loading the gun. However, a loaded gun is dangerous in that it can be easily and accidentally discharged. Thus it is necessary to provide safety devices to prevent injuries resulting from such accidental discharges.

Many safety devices for guns have been developed. For example, safety catches on the trigger mechanism of the gun are very common. When the safety catch is "on" the trigger is immobilized and the trigger cannot then be accidentally activated resulting an unintentional firing of the gun. However, due to their small size and location, these devices are not always visible, particularly in dark or adverse weather conditions. One cannot always see whether the gun safety device is on or off merely by taking a quick glance at the gun. Furthermore, the activation and deactivation of a safety catch can become an automatic reaction for the gun handler. Such an handler may not then be consciously aware of whether the catch is activated or not, and may mistakenly believe that the catch is on, when in fact it is not.

Other safety devices have been developed including those that require a dummy cartridge, a key or a complex trigger locking system. These types of safety devices are not easily disengaged and are therefore inappropriate for situations where the gun must be fired quickly, such as when encountering prey or when facing an intruder. Furthermore, such devices tend to be complex and are generally directed to a specific type or make of firearm.

U.S. Pat. No. 4,777,753 by Stancato shows a gun safety device mounted on a gun barrel for capturing a projectile. A bullet expelled by a gun is caught by a rigid metal enclosure mounted on the gun barrel. The device disclosed therein is complex, heavy and cumbersome. Moreover, this proposal is mainly concerned with a device that is lockable, and for this purpose, provides a complex and cumbersome combination lock mechanism. The rigid enclosure may require more than one chamber in order to fully absorb the impact of the bullet expelled from the gun.

SUMMARY OF THE INVENTION

It is therefore desirable to provide a gun safety device that can be easily attached to and detached from a gun barrel.

It is also desirable that the gun safety device be lightweight, simple to manufacture, and capable of being used in connection with many different types of firearms.

Preferably, such a gun safety device should be clearly visible when in use.

It is an advantage for the gun safety device to prevent foreign materials from entering the gun barrel while the gun is being carried or stored.

Accordingly, the present invention provides a gun safety device which comprises a mounting means for securing the device on the gun barrel, and a projectile capturing means, attached to the mounting means where the projectile capturing is comprised of fibrous fabric, so that when the gun is fired, the projectile capturing means is capable of capturing the projectile.

The present invention also includes a method for capturing a projectile from a gun comprising the steps of mounting a projectile capturing means comprised of fabric onto a gun barrel, firing a projectile from the gun barrel, capturing the projectile within the projectile capturing means, and releasing the gases expelled from the gun barrel during firing through pressure release holes located within the projectile capturing means.

BRIEF DESCRIPTION OF THE DRAWINGS

For a better understanding of the present invention, and to show more clearly how it may be carried into affect, reference will now be made, by way of example to the preferred embodiment of the present invention shown in the ,accompanying drawing in which.

DESCRIPTION OF THE PREFERRED EMBODIMENT

Figure 1:
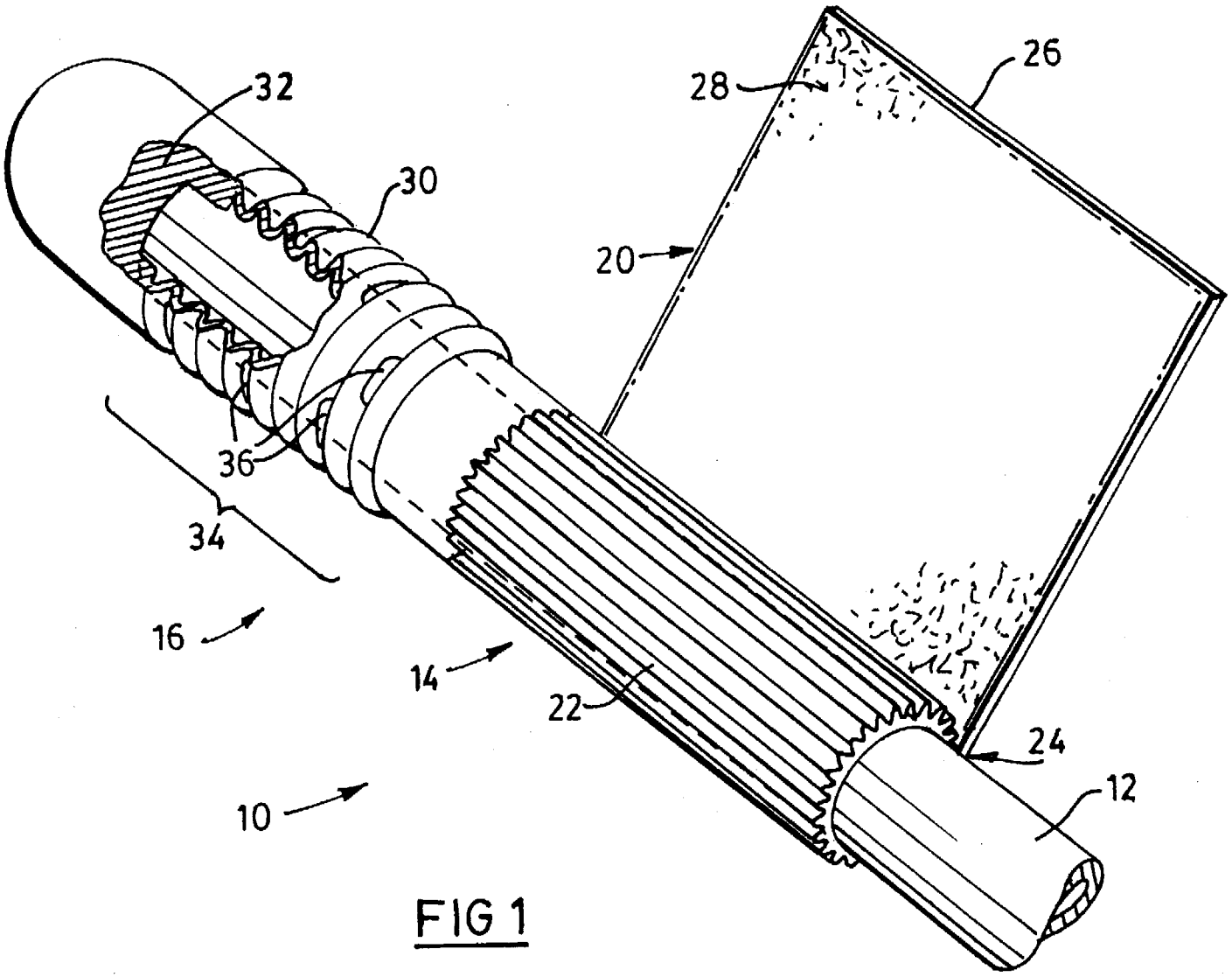
FIG. 1 is a perspective view of a firearm safety device in accordance with the present invention.

Referring now to FIG. 1, a firearm safety device is shown generally at 10 mounted on a gun barrel 12. The safety device 10 has a mounting means 14 and a projectile capturing means 16.

The mounting means 14 comprises a strap 20 and a section of fabric 22. The fabric section 22 is cylindrically shaped and is adapted to surround the circumference of the gun barrel 12. The strap 20 is sewn at one end 24 to the fabric section 22. To mount the device on the gun barrel 12, the strap 20 is tightly wrapped circumferentially around the gun barrel 12 and the fabric section 22. The free end 26 of the strap 20 is then fastened by a fastening means 28, which in the present embodiment is a hook and loop component system sold under the trade mark VELCRO.

The fabric section 22 is preferably provided with a stitch that causes the section 22 to contract radially, when the section 22 is extended longitudinally. This will cause the pressure between the section 22 and the gun barrel 12 to increase with increasing axial load, which in turn will increase the frictional forces retaining the device 10 in position.

To achieve this effect the fabric section 22 consists of a woven fabric which is cut on the bias, and the bias is aligned with the longitudinal axis of the gun barrel. When the projectile is fired its momentum will tend to elongate the projectile capturing means which will in turn will cause the fabric section 22 to stretch in the longitudinal direction. Stretching the fabric section 22 in the longitudinal direction of the gun barrel 12 will result in concurrent retraction of the fabric section 22 in the transverse or circumferential direction of the gun barrel 12 due to the bias cut. Thus the fabric section 22 will be drawn more tightly against the gun barrel 12, which will assist in anchoring the safety device 10 on the gun barrel 12.

In woven material, individual fibers are essentially straight (when the fabric is flat), and when cut on the bias, each fiber would wind helically around the gun barrel at an angle of approximately 45° to the axis. When tension is applied at one end of the section 22, each fiber is tensed. Due to the helical orientation of each fiber it will be pressed more strongly against the gun barrel. It is believed that, for a certain minimum length of the section 22, it will be virtually impossible to remove the safety device 10 simply by pulling on projectile capturing means 16 (i.e. by applying an axial tensile load to the section 22). This in turn means that impact of projectile should not remove the device 10. This minimum length will depend on the dimensions of the various components, the presence of lubricating oil, and the relative coefficient of friction etc. It will also likely depend on whether the end of the barrel 12 is a smooth cylinder or includes some projecting sight feature or the like.

To maximize this effect, the section 22 can include elastic material running circumferentially around it, and this is preferably provided adjacent the free end of the section 22.

Alternatively, the fabric section 22 can be comprised of knitted fabric which may have a stitch aligned such that it too will contract circumferentially when the fabric section 22 is stretched longitudinal by the momentum of the bullet.

The fabric section 22 is fibrous and comprised of an industrial strength fiber, such as the fiber sold under the trade mark KEVLAR®. KEVLAR® is a high modulus yarn or fiber which is a member of the aramid family of fibers and is based on polyacrolonitrile, a polymer. The fabric section 22 may be reinforced with extra elastics to provide further anchoring effect for the mounting means 14.

To enhance the security of the mounting provided by the mounting means 14, an anti-stick coating may be added to the surface of the fabric section 22 which is in contact with the gun barrel 12. For some purposes, knitted KEVLAR® is sold with an anti-stick coating in the form of small circles of polymeric material adhered to the knitted fabric. This form of anti-stick coating is suitable for the mounting means 14 contemplated by the present invention, as it enables the material to contract radially while extending axially.

If secure mounting is of particular concern, a clamping device can be used in addition to the mounting means 14.

The projectile capturing means 16 is comprised of fabric knitted from KEVLAR® fibers and is closed at one end to form a sock-like enclosure for the end of the gun barrel 12. The projectile capturing means 16 and the fabric section 22 are knitted or joined together at their interface so that they form a continuous sleeve.

The projectile capturing means 16 includes two zones: a stretch zone 30 and an impact absorption zone 32. The stretch zone 30 includes transverse circular gathers 34 which elongate when a projectile is captured by the projectile capturing means 16, thereby absorbing some of the momentum of the projectile. Advantageously, pressure release apertures 36 are included in the projectile capturing means 16. When a projectile is fired from a gun, explosive gases are expelled from the end of the gun barrel 12. With the gun safety device 10, mounted on the gun barrel 12, these gases will also be captured by the projectile capturing means 16. Although the knitted structure of the fabric will allow some of these gases to escape, the pressure release apertures 36 are larger than the spaces in the knitted structure, to ensure that all or most of the gases are allowed to escape, avoiding the creation of excessive pressure within the safety device 10.

The impact absorption zone 32 absorbs the momentum of the fired projectile as it impacts the gun safety device 10. The impact absorption zone is comprised of layers of the fabric knitted from KEVLAR® fibers. The layers are of sufficient thickness to absorb most of the impact of a projectile discharged from a typical firearm. For example, it is believed that a thickness of one inch of fabric made from KEVLAR® fibers is sufficient for a bullet from a 22 caliber single bullet rifle. However, thickness required in each case will depend on the momentum of the projectiles, which will vary with different makes of firearms.

Alternatively, the impact absorption zone may be comprised of a plurality of fine strands of KEVLAR® fibers randomly and densely interengaged to form padding which absorbs the impact of the projectile.

In operation, the gun safety device 10 is placed over the firing end of the gun barrel 12 so that the fabric section 22 grips the gun barrel 12. The anti-stick coating on the fabric section 22 also grips the gun barrel 12. The mounting means 14 is engaged by wrapping the strap 20 around the fabric section and fastening the fastening means 28. If the gun is accidentally discharged, the projectile will be captured by the projectile capturing means 16, with the impact of the projectile absorbed in the stretch zone 30 and the impact absorption zone 32. Gases expelled during discharge escape through the pressure release holes The moment-am of the projectile may be such that the gun safety device is pulled from the gun barrel 12. However, even if this occurs, the majority of the momentum of the projectile will have been absorbed by the device and the soft knifed fabric of the gun safety device 10 will drift relatively harmlessly from the gun, and at the most may impact a human body causing bruising. However, serious injury will be avoided as the projectile, encased in the soft fabric of the safety device 10 should not penetrate the human body.

The safety device of the present invention is more visible than other safety devices as fabric made from KEVLAR® fibers is generally brightly coloured, most commonly in a bright yellow, and would therefore be evident to the gun handler whether or not the device was in operation. It location and size make it easy to identify whether it is in operation even in adverse visibility conditions.

The simple strap and VELCRO® fastening means provides a gun safety device that can be easily attached and detached to a gun barrel and is capable of being used in connection with many different types of firearms since the strap can adjust to varying sizes of gun barrels.

The knitted fabric is light-weight, easy to use in manufacturing and readily available on the current market. As it is formed of fabric, it can readily be folded up and placed in a pocket.

Since the projectile capturing means is a closed sleeve, the end of the gun barrel will be encased, preventing foreign materials from entering the gun barrel while the gun is being carried or stored.

While the above description constitutes the preferred embodiment, it will be appreciated that the present invention is susceptible to modification and change without departing from the fair meaning or proper scope of the accompanying claims. For example, the fabric section 22 and the projectile capturing means 16 need not necessarily form a continuous sleeve, but rather, may be two separate sections of fabric attached to each other by some means such as sewing. Furthermore, it will be understood that the fabric need not be made from KEVLAR®, but may be any industrial strength fabric which can withstand the conditions associated with the firing of projectiles from a firearm.

For the stretch zone 30, if a suitable stitch is chosen, which gives an open texture to the fabric, it may be possible to eliminate the discrete pressure release apertures 36.

It may not be necessary for all of the device to be made of KEVLAR® or equivalent material; it may prove sufficient for just relevant parts of the projectile capturing means 16 to be formed of KEVLAR®. The device can be formed from two or more different fibers and possibly may comprise mixed woven and knitted sections. Also, each section could be knitted with a different stitch, and this is almost certainly necessary for the stretch zone 30.

It is anticipated that the device could be manufactured in different standard sizes to use with corresponding standard sizes of gun barrels.

I claim:

1. A gun safety device, for use with a gun for firing a projectile and having a barrel, comprising:

a mounting means for securing the device on the gun barrel, and a projectile capturing means attached to the mounting means, said projectile capturing means comprising fibrous fabric, wherein when the device is mounted on the gun barrel, the projectile capturing means is capable of capturing a projectile fired from the gun.

2. The device as claimed in claim 1, wherein the projectile capturing means further comprises an impact absorption zone for absorption of the momentum of the fired projectile.

3. The device as claimed in claim 2, wherein the projectile capturing means further comprises a stretch zone permitting elongation of the projectile capturing means during capture of the projectile, and dissipation of the momentum of a fired projectile.

4. The device as claimed in claim 3, wherein the projectile capturing means further comprises pressure release apertures for the release of gases expelled from the gun barrel during firing and into the projectile capturing means.

5. The device as claimed in claim 1 wherein the mounting means is formed from fabric and comprises a strap adapted to be circumferentially wrapped around the gun barrel, and fastening means, so that when the strap is wrapped around the gun barrel and the fastening means is engaged, the device is secured to said gun barrel.

6. The device as claimed in claim 5 wherein the mounting means further comprises an anti-slip coating located on the surface of the mounting means which contacts a gun barrel, whereby the anti-slip coating resists removal of the device from the gun barrel during capture of the projectile.

7. The device as claimed in claim 1, 2, 3 or 4, wherein the mounting means is formed from fabric which is formed such that an axial tensile load applied thereto by the projectile capturing means causes the mounting means to press radially against the barrel, to resist removal of the device.

8. The device as claimed in claim 7 wherein the mounting means further comprises a section of fabric which has been cut on the bias and the bias aligned with the longitudinal axis of the gun barrel, whereby elongation of said fabric caused by the momentum of the projectile causes a radial retraction of the fabric against the gun barrel to retain the device on the gun barrel.

9. The device as claimed in claim 7, wherein the mounting means includes a section of fabric which is knitted with a stitch which is such that elongation of said knitted fabric caused by the momentum of the projectile causes a radial retraction of the fabric against the gun barrel to retain the device on the gun barrel.

10. The device as claimed in claim 2 wherein said impact absorption zone is comprised of layers of fabric.

11. The device as claimed in claim 2, wherein said impact absorption zone is comprised of interengaged fabric fibers forming padding.

12. The device as claimed in claim 3, wherein the stretch zone of the projectile capturing means is comprised of transverse fabric gathers.

13. A method of capturing a projectile fired from a gun having a barrel, comprising the steps of mounting a projectile capturing means comprised of fabric onto the barrel of the gun, firing a projectile from the barrel of the gun, capturing the projectile within the projectile capturing means, and releasing the gases expelled from the gun barrel during firing through pressure release apertures located within the projectile capturing means.

14. The device as claimed in claim 1 where the fibers of the fabric are interlaced by weaving.

15. The device as claimed in claim 1 where the fibers of the fabric are interlaced by knitting.

16. The method of claim 13 wherein the fibers of the fabric are interlaced by weaving.

17. The method of claim 13 wherein the fibers of the fabric are interlaced by knitting.

* * * * *